US010271707B2

(12) United States Patent
Persson

(10) Patent No.: US 10,271,707 B2
(45) Date of Patent: Apr. 30, 2019

(54) ALTERNATING PUMP DIRECTION FOR FLUID DETECTION

(71) Applicant: ELECTROLUX APPLIANCES AKTIEBOLAG, Stockholm (SE)

(72) Inventor: David Persson, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 15/531,610

(22) PCT Filed: Dec. 15, 2014

(86) PCT No.: PCT/EP2014/077800
§ 371 (c)(1),
(2) Date: May 30, 2017

(87) PCT Pub. No.: WO2016/095950
PCT Pub. Date: Jun. 23, 2016

(65) Prior Publication Data

US 2017/0347855 A1 Dec. 7, 2017

(51) Int. Cl.
*A47L 15/42* (2006.01)
*A47L 15/00* (2006.01)
(Continued)

(52) U.S. Cl.
CPC ..... *A47L 15/0049* (2013.01); *A47L 15/4202* (2013.01); *A47L 15/4217* (2013.01); *A47L 15/4225* (2013.01); *A47L 15/4244* (2013.01); *A47L 15/449* (2013.01); *A47L 15/46* (2013.01); *D06F 33/02* (2013.01); *D06F 39/082* (2013.01); *A47L 2401/08* (2013.01);
(Continued)

(58) Field of Classification Search
CPC ..... A47L 15/4202
See application file for complete search history.

(56) References Cited

U.S. PATENT DOCUMENTS

2014/0124005 A1* 5/2014 Ugel ..... A47L 15/4244 134/18

FOREIGN PATENT DOCUMENTS

DE 102008029910 A1 12/2009
WO WO-2005/089621 A1 9/2005
WO WO-2014/071981 A1 5/2014

OTHER PUBLICATIONS

International Search Report and Written Opinion for International Patent Application No. PCT/EP2014/077800 dated Apr. 9, 2015, 9 pages.

* cited by examiner

*Primary Examiner* — Jason Y Ko
(74) *Attorney, Agent, or Firm* — Alston & Bird LLP

(57) ABSTRACT

A domestic appliance and a method at the domestic appliance for detecting presence of process water in a pump of the domestic appliance are provided. The method of detecting process water in a pump of a domestic appliance may include operating the pump to rotate in a first direction, recording a first response of the pump rotating in the first direction based on a measured pump operation parameter, operating the pump to rotate in a second direction, and recording a second response of the pump rotating in the second direction based on the measured pump operation parameter. The method may further include comparing the first response and the second response, and determining the presence of water in the pump based on the comparison of the first and second response.

18 Claims, 4 Drawing Sheets

(51) Int. Cl.

| | |
|---|---|
| ***A47L 15/44*** | (2006.01) |
| ***A47L 15/46*** | (2006.01) |
| ***D06F 39/08*** | (2006.01) |
| ***D06F 33/02*** | (2006.01) |

(52) U.S. Cl.
CPC ..... *A47L 2501/01* (2013.01); *A47L 2501/05* (2013.01); *A47L 2501/26* (2013.01); *D06F 2202/12* (2013.01); *D06F 2204/06* (2013.01); *D06F 2204/10* (2013.01)

ALTERNATING PUMP DIRECTION FOR FLUID DETECTION

CROSS-REFERENCE TO RELATED APPLICATIONS

This application is a national stage application filed under 35 U.S.C. § 371 of International Application No. PCT/EP2014/077800 filed Dec. 15, 2014, which is hereby incorporated by reference in its entirety.

TECHNICAL FIELD

The invention relates to a domestic appliance and a method at the domestic appliance for detecting presence of process water in a pump of the domestic appliance.

BACKGROUND

In domestic appliances, such as for instance dishwashers or washing machines, it may for various reasons be desirable to measure presence of water in the appliance.

As an example, it may be desirable to detect an overfill situation in the appliance. Thus, in order to detect whether a washing compartment of the appliance is filled with an excessive amount of process water, due to e.g. a faulty inlet valve or inferior water filling control, overfill sensors have been used in the art. Typically, the overfill sensors have been embodied in the form of pressure sensors for determining amount of process water in the washing compartment.

In another example, it may be desirable to detect filter clogging in the appliance. Dishwashers comprise a filter at a bottom of a washing compartment for filtering soil from process water being recirculated in the dishwasher by means of a circulation pump. This is undertaken in order to prevent dirty process water from being recirculated and sprayed onto goods to be washed. When an excess amount of soil adheres to the filter, the filter becomes clogged and the water will ultimately not pass through the filter. It may thus be desirable to detect filter clogging such that the filter can be cleaned in order for the dishwasher to reach its full washing capability.

International patent application having publication number WO 2005/089621 discloses a dishwasher and a method of controlling the dishwasher, where effects influencing washing performance negatively such as for example filter clogging are identified by detecting current drawn by a circulation pump of the dishwasher. For instance, if it is detected that the current of the circulation pump fluctuates within a proper range, it is concluded that the filter is clogged and that the pump therefore draws a mixture of air and water. A disadvantage of the approach set forth in WO 2005/089621 is that an absolute level of current drawn by the circulation pump must be detected in order to determine e.g. filter clogging. Such a level may vary with a number of parameters such as age, temperature, type of pump, individual pump variations, etc.

SUMMARY

An object of the present invention is to solve, or at least mitigate, this problem in the art and thus to provide an improved method of detecting presence of process water in a pump of a domestic appliance.

This object is attained in a first aspect of the present invention by a method of detecting presence of process water in a pump of a domestic appliance. The method comprises operating the pump to rotate in a first direction, recording a first response of the pump rotating in the first direction based on a measured pump operation parameter, operating the pump to rotate in a second direction, and recording a second response of the pump rotating in the second direction based on the measured pump operation parameter. The method further comprises comparing the first response and the second response, and determining the presence of water in the pump based on the comparison of the first and second response.

This object is attained in a second aspect of the present invention by a domestic appliance configured to detect presence of process water in a pump comprised in the domestic appliance. The appliance comprises a processing unit being operative to operate the pump to rotate in a first direction, to record, in a memory, a first response of the pump rotating in the first direction based on a measured pump operation parameter, to operate the pump to rotate in a second direction, and to record, in the memory, a second response of the pump rotating in the second direction based on the measured pump operation parameter. The processing unit is further operative to compare the first response and the second response, and to determine the presence of process water in the pump based on the comparison of the first and second response.

Thus, the circulation pump is initially operated to rotate in a first direction. Typically, the processing unit applies a short pulse to a motor driving the pump to have the pump rotate in the first direction. As an example, the input pulse could be applied such that the pump reaches a certain target rotational speed, while the processing unit monitors e.g. operating current of the pump motor. Once the target rotational speed is reached, the motor is turned off. The processing unit records, in a memory, the response of the pump rotating in the first direction. Thereafter, the processing unit operates the pump to rotate in a second, opposite direction and records a response of the pump rotating in the opposite direction. Now, if there is no (or just a small amount of) process water in the pump, the first response will be identical (or near identical) to the second response, possibly with a change in sign due to the change in pump direction.

Since there is no water in the pump, the pump will only draw air, and the first and the second response will advantageously be identical (or symmetrical around zero in case of a change of sign). Hence, the processing unit compares the first response and the second response, and if they are identical (or symmetrical around zero), the processing unit concludes that there is no or little water in the pump.

However, if there is process water present in the pump, the second response is rather different from the first response; an impeller of the circulation pump causes any water in the pump to rotate in the direction of the pump, thereby giving any process water or liquid a rotating momentum in the first direction, whereby a change in the rotational direction of the pump will cause the rotating momentum to act against the motor trying to change the circulation pump direction. As a result, the pump will require more power/energy in the direction change, causing the operating current of the motor to increase when the pump rotates in the second direction.

If for instance the processing unit controls an inlet valve for filling up a compartment of the appliance, being for instance a dishwasher, and expects the appliance to have been filled up, it can advantageously be concluded that something is not working correctly, such as a blocked water inlet or a defect inlet valve. In another scenario, the processing unit may use the information to advantageously conclude that the appliance is empty on process water and that a drain pump can be turned off.

Further advantageous is that, with the present invention, in contrast to prior art, the need for knowing e.g. exact motor pump current or power levels for determining presence of water in the pump is advantageously obviated. For instance, with the method according to embodiments of the present invention, it is advantageously not necessary to know absolute current levels at certain rotational speeds and/or certain pump saturation. Further advantageous is that the need to take into account how these parameters changes with age, temperature, type of pump, etc., is obviated.

Preferred embodiments of the present invention will be discussed in the following.

It should be noted that the response of the pump based on a pump operating parameter such as motor current, voltage, power, etc., typically is recorded continuously as the motor is operated.

By the expression "process water" as used herein, is meant a liquid containing mainly water that is used in and circulates in a dishwasher. The process water is water that may contain detergent and/or rinse aid in a varying amount. The process water may also contain soil, such as food debris or other types of solid particles, as well as dissolved liquids or compounds. Process water used in a main wash cycle is sometimes referred to as the wash liquid. Process water used in a rinse cycle is sometimes referred to as cold rinse or hot rinse depending on the temperature in the rinse cycle.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art.

Figure 1:
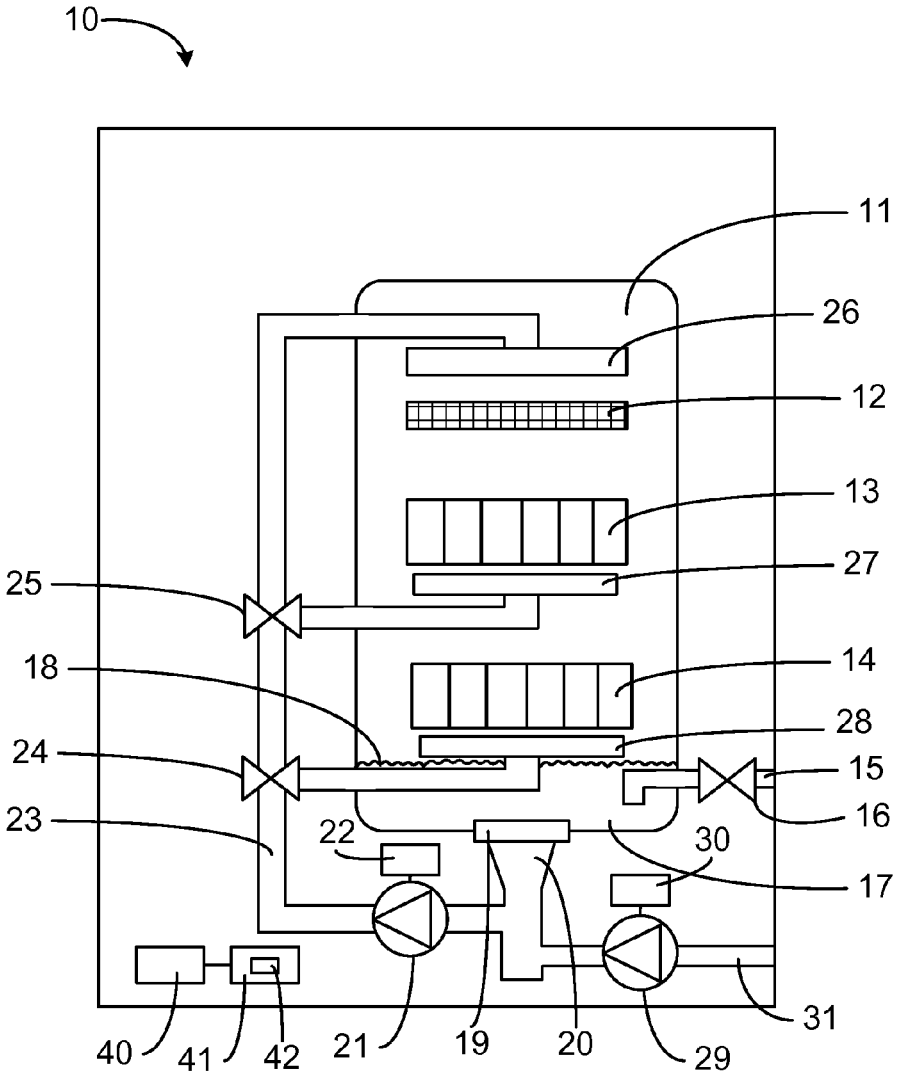
FIG. 1 shows a prior art dishwasher in which the present invention advantageously may be applied.

FIG. 1 shows a domestic appliance in the form of a dishwasher 10 in which the present invention can be implemented. It should be noted that dishwashers can take on many forms and include many different functionalities. Other domestic appliances can be envisaged, such as for instance washing machines. The dishwasher 10 illustrated in FIG. 1 is thus used to explain different embodiments of the present invention and should only be seen as an example of a dishwasher in which the present application can be applied. The dishwasher 10 comprises a washing compartment or tub 11 housing an upper basket 12, a middle basket 13 and a lower basket 14 for accommodating goods to be washed. Typically, cutlery is accommodated in the upper basket 12, while plates, drinking-glasses, trays, etc. are placed in the middle basket 13 and the lower basket 14.

Detergent in the form of liquid, powder or tablets is dosed in a detergent compartment located on the inside of a door (not shown) of the dishwasher 10 by a user, which detergent is controllably discharged into the washing compartment 11 in accordance with a selected washing programme. The operation of the dishwasher 10 is typically controlled by processing unit 40 (referred to as microprocessor in the following) executing appropriate software 42 from a memory 41.

Fresh water is supplied to the washing compartment 11 via water inlet 15 and water supply valve 16. This fresh water is eventually collected in a so called sump 17, where the fresh water is mixed with the discharged detergent resulting in process water 18. At the bottom of the washing compartment is a filter 19 for filtering soil from the process water before the process water leaves the compartment via process water outlet 20 for subsequent re-entry into the washing compartment 11 through circulation pump 21. Thus, the process water 18 passes the filter 19 and is pumped through the circulation pump 21, which typically is driven by a brushless direct current (BLDC) motor 22, via a conduit 23 and respective process water valves 24, 25 and sprayed into the washing compartment 11 via nozzles (not shown) of a respective wash arm 26, 27, 28 associated with each basket 12, 13, 14. Thus, the process water 18 exits the washing compartment 11 via the filter 19 and is recirculated via the circulation pump 21 and sprayed onto the goods to be washed accommodated in the respective basket via nozzles of an upper washing arm 26, middle washing arm 27 and lower washing arm 28.

A drain pump 29 is driven by a BLDC motor 30 for draining the dishwasher 10 on process water 18 via a drain outlet 31, when required. It should be noted that it can be envisaged that the drain pump 29 and the circulation pump 21 may be driven by one and the same motor.

In an embodiment of the present invention, the circulation pump 21 is operated for detecting whether there is water in the circulation pump 21 (and hence in the dishwasher 10). For instance, it may be desirable to detect whether the washing compartment 11 is filled up with water. In case of e.g. a faulty inlet valve or inferior water filling control, the filling up of the machine may fail.

Figure 2:
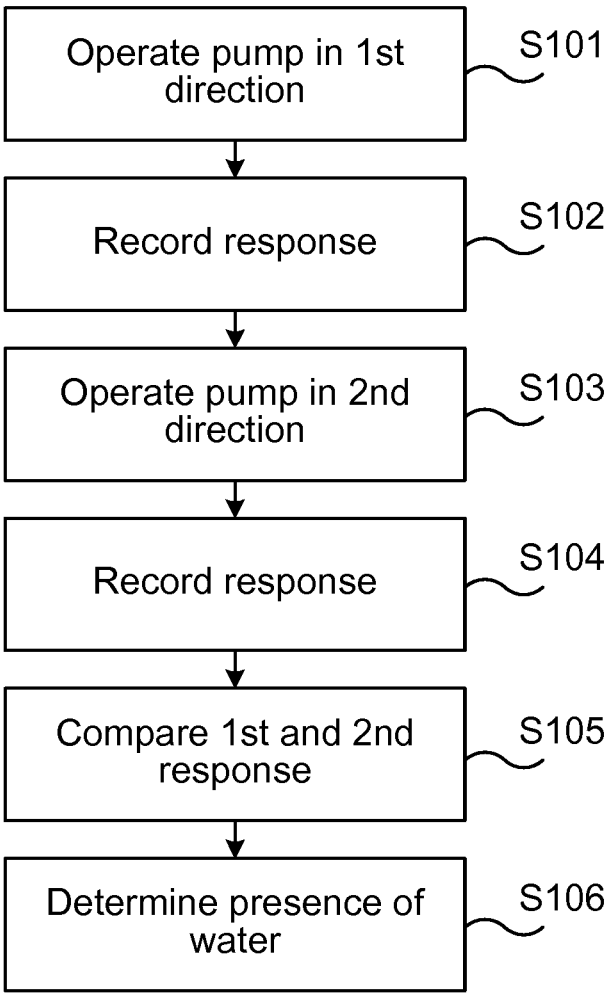
FIG. 2 shows a flowchart illustrating a method of detecting process water in a pump of a domestic appliance according to an embodiment of the present invention.

FIG. 2 illustrates a flowchart of a method of detecting process water 18 in the circulation pump 21 of the dishwasher 10. It should be noted that the method alternatively could be undertaken at the drain pump 29. In a first step S101, the circulation pump is operated to rotate in a first direction. Typically, the microprocessor 40 applies a short pulse to the motor 22 to have the circulation pump 21 rotate in the first direction. As an example, the input pulse could be applied such that the pump 21 reaches a certain target rotational speed, while the microprocessor monitors e.g. operating current of the circulation pump motor 22. Once the target rotational speed is reached, the motor 22 is turned off.

Figure 3A:
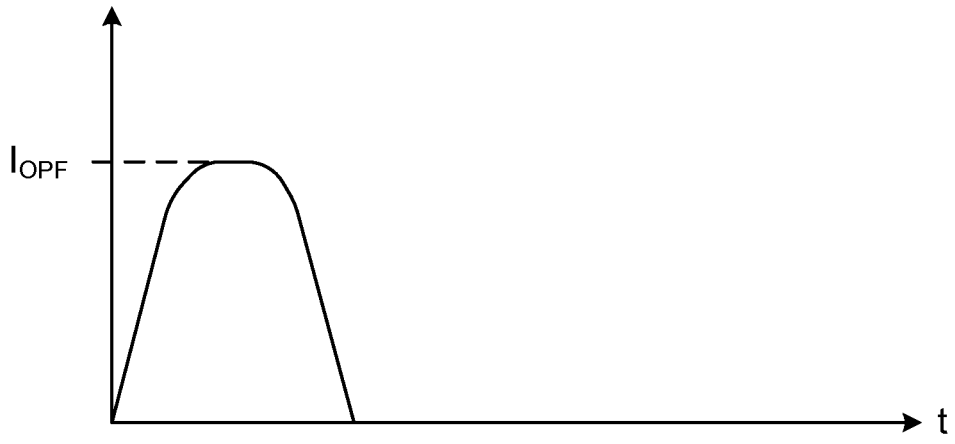
FIG. 3*a* illustrates a response of the pump rotating in a first direction when no water is present in the pump according to an embodiment of the present invention.

An exemplifying pump response is shown in FIG. 3*a* as monitored operating current of the circulation pump motor 22 for the applied input pulse. The microprocessor 40 records, in step S102, the response of the circulation pump 21 rotating in the first direction in the memory 41. Thereafter, in step S103, the microprocessor 40 operates the circulation pump 21 to rotate in a second, opposite direction and records in step 104 a response of the circulation pump 21 rotating in the opposite direction in the memory 41. An exemplifying pump response of the pump rotating in the opposite direction is shown in FIG. 3*b*.

Figure 3B:
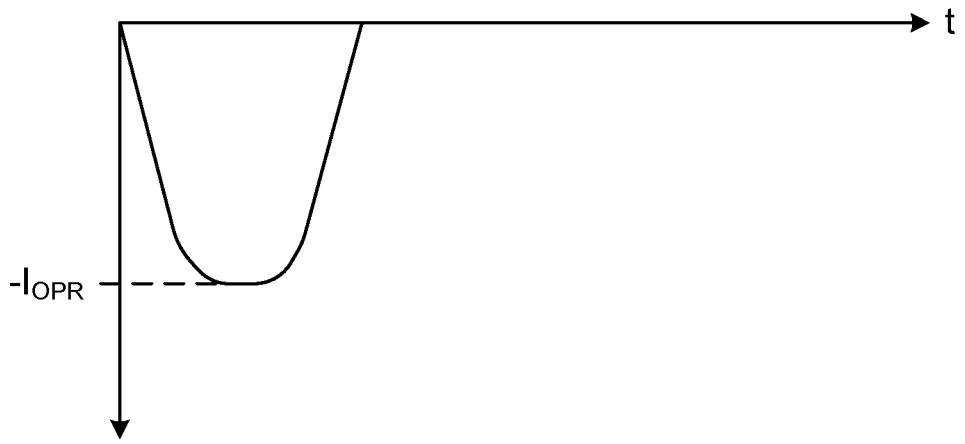
FIG. 3*b* illustrates a response of the pump rotating in a second direction when no water is present in the pump according to an embodiment of the present invention.

Now, if there is no—or just a small amount of—process water 18 in the pump, the first response of FIG. 3*a* will be identical (or near identical) with the second response shown in FIG. 3*b*; since there is no water 18 in the pump 21, the pump will only draw air, and the response will be symmetrical around zero. Thus, the first response will correspond to the second response, possibly with a difference in sign, as is illustrated in FIGS. 3*a* and 3*b*. When no, or just a small amount of, water 18 is in the pump 21, the operating current of the motor 22, will rise quickly until the motor reaches the predetermined target rotational speed to a value of $I_{OPF}$ in the forward direction and to a value of $-I_{OPR}$ in the reverse, and then almost instantaneously fall to zero.

Thus, in step S105, the microprocessor 40 compares the first response and the second response, and if they are identical (possibly with a difference in sign as set out in FIGS. 3*a* and *b*), the microprocessor 40 concludes in step S106 that there is no or little water in the circulation pump 21. Hence, $I_{OPF}+(-I_{OPR})=1$, due to the symmetrical responses.

If the microprocessor 40 controls the inlet valve 16 for filling up the compartment 11, and expects the appliance 10 to have been filled up, it can advantageously be concluded that something is not working correctly, such as a blocked water inlet 15 or a defect inlet valve 16.

As previously was mentioned, the method of detecting water in a pump as described with reference to FIG. 2 may further be implemented at the drain pump 29 instead of (or in combination with) the circulation pump 21. Using the drain pump 29 is advantageous for e.g. detecting whether the appliance 10 has been emptied on process water 18 and that the drain pump motor 30 as a result can be turned off.

With the method of the present invention, the need for knowing e.g. exact motor pump 22, 30 current or power levels for determining presence of water 18 in the pump 21, 29 is advantageously obviated. For instance, with the method according to embodiments of the present invention, it is advantageously not necessary to know absolute current levels at certain rotational speeds and/or certain pump saturation. Further advantageous is that the need to take into account how these parameters changes with age, temperature, type of pump, etc., is obviated.

Figure 4A:
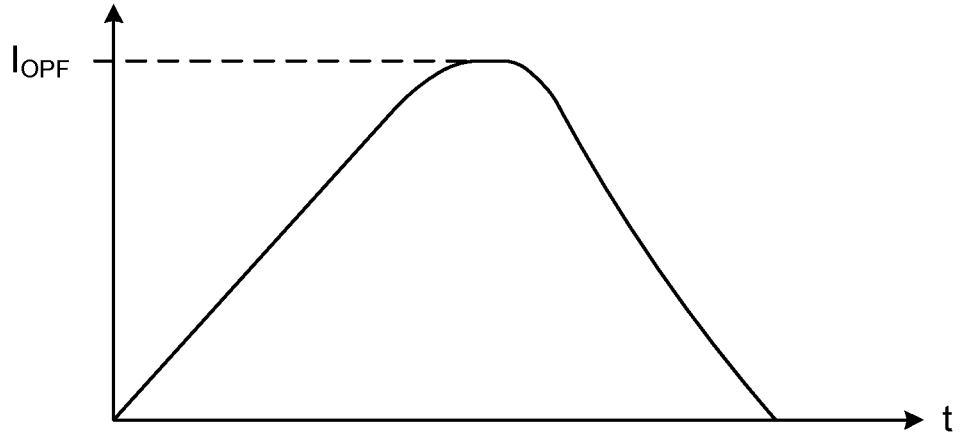
FIG. 4*a* illustrates a response of the pump rotating in a first direction when water is present in the pump according to an embodiment of the present invention.

FIG. 4*a* illustrates an exemplifying pump response again in the form of monitored operating current of the circulation pump motor 22 for the applied input pulse where a target rotational speed of the motor is to be reached, but this time with water 18 present in the pump 21. The microprocessor 40 thus operates the pump 21 to rotate in the first direction in step S101 and records, in step S102, the response of the circulation pump 21 rotating in the first direction in the memory 41. As can be seen, in comparison to the response of FIG. 3*a*, the motor 22 will require a higher operating current $I_{OPF}$ and more time to have the circulation pump 21 reach the predetermined target speed.

Figure 4B:
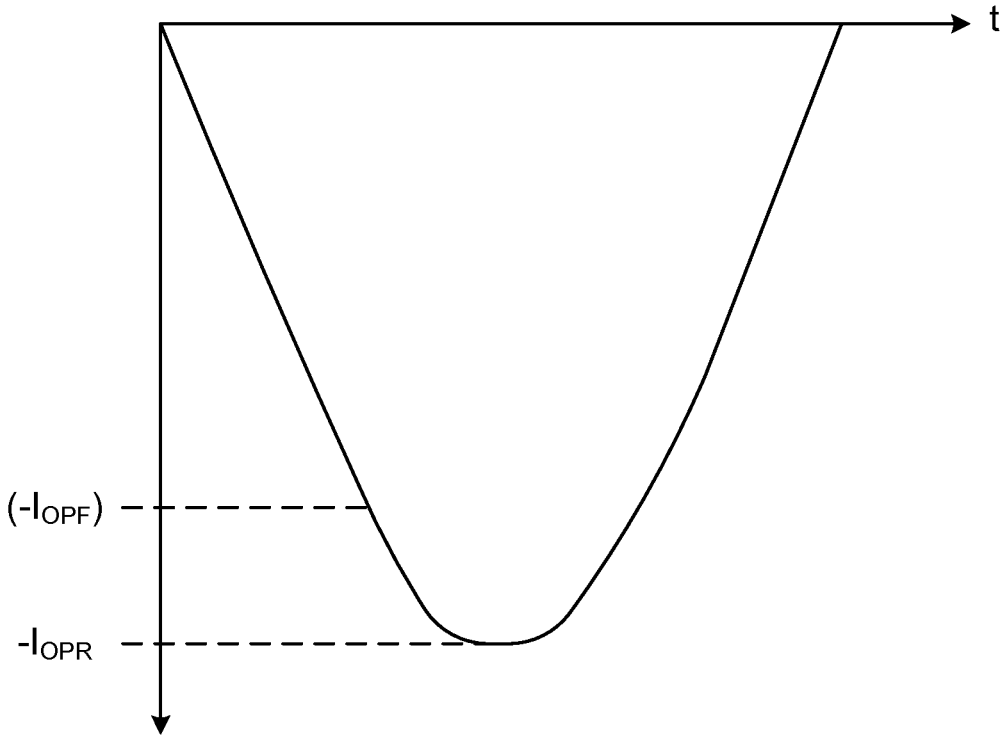
FIG. 4*b* illustrates a response of the pump rotating in a second direction when water is present in the pump according to an embodiment of the present invention.

Thereafter, in step S103, the microprocessor 40 operates the circulation pump 21 to rotate in the opposite direction and records in step 104 a response of the circulation pump 21 rotating in the opposite direction in the memory 41. An exemplifying pump response of the pump rotating in the opposite direction is shown in FIG. 4*b*. Now, as is illustrated in FIG. 4*b*, the second response is rather different from the first response; the motor 22 will require an even higher operating current $-I_{OPR}$ and more time to have the circulation pump 21 reach the predetermined target speed. Hence, $I_{OPF}+(-I_{OPR})\neq 0$, due to the unsymmetrical responses. It should be noted that in case there is water present in the pump the two responses would be asymmetrical even if the pump itself is perfectly forward/reverse symmetrical.

The asymmetry of the responses becomes even more apparent if the altering from the first direction to the second direction is performed instantly, without any pause, since an impeller (not shown) of the circulation pump 21 causes any water in the pump 21 to rotate in the direction of the pump, thereby giving any process water or liquid a rotating momentum in the first direction, whereby a change in the rotational direction of the pump 21 will cause the rotating momentum to act against the motor 22 trying to change the circulation pump 21 direction. As a result, the pump 21 will require more power/energy in the direction change, causing the operating current of the motor 22 to increase, even if the pump itself is perfectly forward/reverse symmetrical.

In step S105, the microprocessor 40 compares the first response and the second response, which in this particular example are asymmetrical, whereby the microprocessor 40 concludes in step S106 that there is water 18 present in the circulation pump 21.

A number of operating patterns for the pump can be envisaged. The pump could first be rotated in the reverse direction and then in the forward direction. Further, if the circulation pump 21 and/or the drain pump 29 are busy running a washing programme, they may first be paused before being operated in a first and a second direction. As a further alternative, responses can be compared by performing a first pump operation sequence of pause-forward-reverse with a second pump operation sequence of pause-reverse-forward; if there is no or a small amount of water in the pump, the result of the first sequence will be symmetrical with that of the second sequence. Even more elaborate operating patterns can be envisaged, such as forward-pause-reverse-forward-pause, reverse-pause-forward-reverse-pause, etc.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A method of detecting presence of process water in a pump of a domestic appliance, comprising:

operating the pump to rotate in a first direction;

recording a first response of the pump rotating in the first direction based on a measured pump operation parameter;

operating the pump to rotate in a second direction;

recording a second response of the pump rotating in the second direction based on the measured pump operation parameter;

comparing the first response and the second response; and determining the presence of process water in the pump based on the comparison of the first response and the second response, wherein in an instance in which the first response is determined to correspond with the second response, it is determined that the pump comprises no process water.

2. The method of claim 1, wherein the first response being considered to correspond with the second response if the first response is identical to the second response.

3. The method of claim 1, wherein the first response being considered to correspond with the second response if the first and second response is symmetrical around zero.

4. The method of claim 1, wherein the pump is operated to instantly rotate in the second direction after having been operated to rotate in the first direction.

5. The method of claim 1, wherein the measured pump operation parameter comprises one or more of operating current, voltage, and power of a motor driving the pump while operating the pump in the first and the second direction.

6. A domestic appliance configured to detect presence of process water in a pump comprised in the domestic appliance, the appliance comprising a processing unit being adapted to:

operate the pump to rotate in a first direction;

record, in a memory, a first response of the pump rotating in the first direction based on a measured pump operation parameter;

operate the pump to rotate in a second direction;

record, in the memory, a second response of the pump rotating in the second direction based on the measured pump operation parameter;

compare the first response and the second response; and determine the presence of process water in the pump based on the comparison of the first response and the second response, wherein in an instance in which the first response is determined to correspond with the second response, the processing unit is adapted to determine that the pump comprises no process water.

7. The domestic appliance of claim 6, the first response being considered to correspond to the second response if the first response is identical to the second response.

8. The domestic appliance of claim 6, the first response being considered to correspond to the second response if the first and second response is symmetrical around zero.

9. The domestic appliance of claim 6, wherein the pump is operated to instantly rotate in the second direction after having been operated to rotate in the first direction.

10. The domestic appliance of claim 6, the measured pump operation parameter comprising one or more of operating current, voltage, and power of a motor driving the pump while operating the pump in the first and the second direction.

11. The domestic appliance of claim 6, said domestic appliance being any one of a dishwasher and a washing machine.

12. A computer program comprising computer-executable components for causing a domestic appliance to perform the steps recited in claim 1 when the computer-executable components are run on a processing unit included in the domestic appliance.

13. A computer program product comprising a non-transitory computer readable medium, the computer readable medium having the computer program according to claim 12 embodied therein.

14. The method of claim 1, wherein in an instance in which the first response is considered to correspond with the second response, it is determined that the pump comprises less than a threshold amount of process water.

15. The method of claim 1, wherein the first response being considered to correspond with the second response if the first response is within a threshold similarity to the second response.

16. The method of claim 1, wherein the first response being considered to correspond with the second response if the first and second response is within a threshold symmetry around zero.

17. The domestic appliance of claim 6, wherein in an instance in which the first response is considered to correspond to the second response, it is determined that the pump comprises less than a threshold amount of process water.

18. The domestic appliance claim 6, the first response being considered to correspond to the second response if the first and second response is within a threshold symmetry around zero.

* * * * *